United States Patent [19]

Anderson

[11] 3,942,715

[45] Mar. 9, 1976

[54] MAILBOX

[76] Inventor: Fred E. Anderson, 104 Bellevue Blvd. North, Bellevue, Nebr. 68005

[22] Filed: Sept. 24, 1973

[21] Appl. No.: 400,422

[52] U.S. Cl. ..... 232/17; 232/34

[51] Int. Cl. ..... A47g 29/12

[58] Field of Search ..... 232/34, 35, 17, 45, 39, 232/38

[56] References Cited

UNITED STATES PATENTS

| | | | |
|---|---|---|---|
| 693,917 | 2/1902 | Sfansel | 232/34 |
| 2,498,260 | 2/1950 | Fabis | 232/34 |
| 3,081,023 | 3/1963 | Taylor | 232/39 X |
| 3,106,335 | 10/1963 | Allan | 232/34 X |
| 3,498,256 | 3/1970 | Hebal | 232/34 X |

*Primary Examiner*—Francis K. Zugel
*Attorney, Agent, or Firm*—Marden S. Gordon

[57] ABSTRACT

A rural delivery type mailbox having an elongated hollow container with a single mail receiving compartment therein, the container normally mounted adjacent a roadway and having a front end with a door therein for the insertion of mail into the compartment, and provided with a door in the rear wall of the container to permit removal of the mail from the compartment without having to force an individual to step into the adjacent roadway and expose himself to oncoming traffic. The rear entrance includes a door hinged at the bottom whereas the front entrance has the hinge at the top such that access to the mail compartment may be gained from both ends of the mailbox.

1 Claim, 6 Drawing Figures

MAILBOX

BACKGROUND OF THE INVENTION

1. Field of the Invention

This invention relates generally to mailboxes and more particularly to a novel and improved mailbox of the type normally used in rural mail delivery and mounted on a post adjacent the roadway where the individual's property abuts the roadway.

2. Description of the Prior Art

Mailboxes having a mail receiving container therein with a fro;nt entrance providing access to the compartment have become conventional for use as rural mailboxes wherein such mailboxes are customarily mounted on posts or stands at a point adjacent the roadway where the individual's property abuts the roadway. To expedite the delivery of mail and to aid the mail carrier in making his appointed rounds on schedule, such mailboxes are customarily positioned adjacent the pavement at a prescribed height above the ground as normally required by the Postmaster General and that will enable the carrier to make his pick-up and deliveries without having to dismount from his vehicle and without having to drive his vehicle off of the roadway. The front end of the mailbox must, therefore, obviously be directed toward the roadway to provide access thereto by the carrier, this providing the highly dangerous and hazardous situation of requiring the individual to stand in the roadway to gain access to the mailbox compartment, this placing the individual in a dangerous position exposed to oncoming traffic. Alternately, an individual may stand next or behind the mailbox and then struggle to remove mail from the compartment, however due to the great inconvenience of removing mail on a daily basis in this manner, it is only normal that most individuals disregard their personal safety in favor of the convenience of standing in the roadway to remove the mail from the mailbox.

SUMMARY OF THE INVENTION

The present invention recognizes this problem of an individual removing his mail from the mailbox and the dangerous situation presently required to do so, and provides a novel and improved solution thereto wherein a mailbox is provided having a front end intended to face the roadway for the deposit of mail thereinto by the carrier, and having a door provided in the back end thereof and facing away from the roadway to permit the individual to remove mail from the mailbox without having to step into the adjacent roadway.

It is a feature of the present invention to eliminate a previously dangerous situation by providing a rear access door to the mailbox compartment disposed opposite the roadway so that an individual can remove the mail without stepping into the roadway.

A further feature of the present invention provides an improved mailbox intended for rural delivery and having one end for a carrier to deposit mail thereinto with the opposite end adapted for an individual to remove mail therefrom.

Still a further feature of the present invention provides a door in the rear of a mailbox to gain access to the mailbox compartment and which door operates in a manner different from the door at the front of the mailbox through which the carrier deposits the mail into the mailbox such that depositing of the mail into the mailbox through the front door will not effect the opening of the rear door.

Yet still a further feature of the present invention provides a mailbox which is relatively inexpensive to manufacture due to its simplicity of construction.

The provision of a mailbox intended for rural mail deliveries, such as briefly outlined above, and possessing the stated advantages, constitutes the principal features of the present invention. The provision of a mailbox which is rugged and durable and which therefore may be guaranteed by the manufacturer to withstand rough usage; one which is aesthetically pleasing and refined in appearance; one which includes a bottom surface having drainage means associated therewith in order that mail placed thereinto will not come in contact with any moisture which might otherwise be found at the bottom surface of a mailbox; and one which, otherwise, is well adapted to perform the services required of it, are further desirable features which have been borne in mind in the production and development of the present invention.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figures 1, 2, 3, 4, 5, 6:
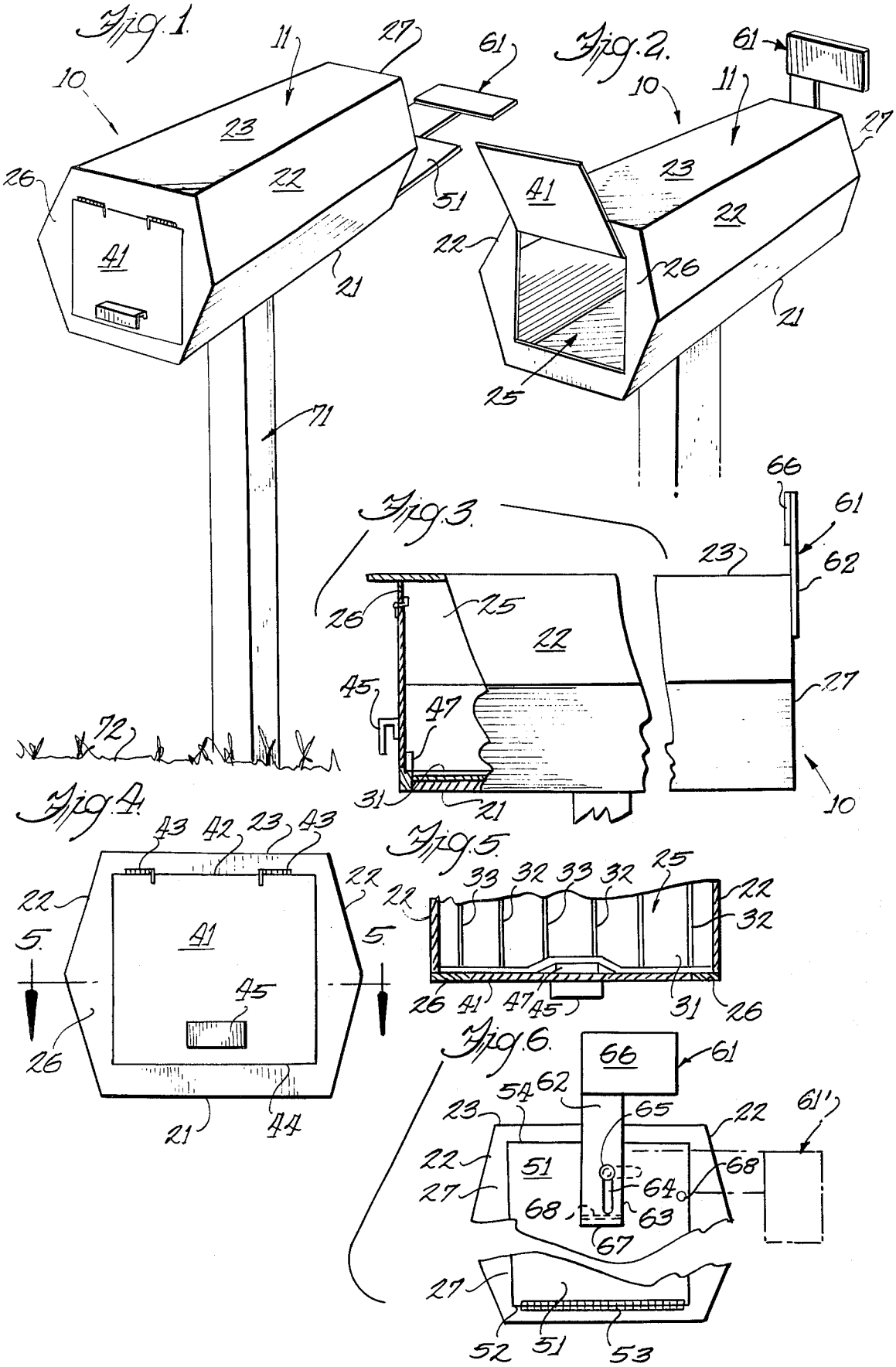
FIG. 1 is a perspective view of a mailbox constructed in accordance with the present invention and having the front entrance door closed with the back entrance door open.
FIG. 2 is a perspective view similar to FIG. 1 but having the front entrance door open with the back entrance door closed.
FIG. 3 is a fragmentary side elevational view of the mailbox, partially broken away to illustrate the internal compartment thereof.
FIG. 4 is a front end elevational view of the mailbox.
FIG. 5 is a fragmentary cross-sectional view taken along Line 5—5 of FIG. 4.
FIG. 6 is a fragmentary rear end elevational view of the mailbox showing the signaling means associated therewith.

Referring now to the drawings in detail there is illustrated a rural type mailbox constructed in accordance with the present invention and designated in its entirety by the reference numeral 10. The mailbox includes a hollow housing container 11 comprising an elongated flat horizontally extending rectangular base 21 having a pair of opposed side walls 22 secured to opposite edges of the base and extending upwardly therefrom, the side walls diverging outwardly from the base to the midpoint thereof and then diverging back inwardly to be joined along their top edges to a flat elongated rectangular horizontal top member 23 which, it is to be understood, may be formed integrally with and joins the upper ends of the side walls to form an enclosed single compartment 25 interiorly thereof. The housing 11 is provided with a vertically extending front end wall 26 and a vertically extending back end wall 27. Further, the bottom surface 21 is provided interiorly thereof in compartment 25 with a longitudinally extending corrugated liner member 31 having a plurality of transversely spaced longitudinally extending side-by-side disposed ridges 32 and valleys 33 to provide a support for mail inserted into compartment 25 in a manner to support such mail off of the valleys of the corrugated lining member which might have moisture thereon so that the mail is retained in a dry protected position.

The front end wall 26 is provided with a door 41 pivotally connected along its top edge 42 by spring loaded hinge members 43 for swinging movement thereabout such that the bottom edge 44 of the door swings in a vertical plane upwardly about the hinge members to open the entrance to the compartment 25, with the door having a handle 45 mounted thereon acting to weight the bottom edge of the door such that after the door has been opened and then released it will return to its closed position due to the effect of gravity along with the effect of the spring loaded hinge member 43. To releasably secure the door in the closed position there is provided a magnet 47 mounted on the bottom surface 21 adjacent the bottom edge 44 of the door and adapted to magnetically hold the door in the closed position while permitting the same to be opened upon the grasping of the handle 45 and the pivoting of the door about the hinge members 43.

In contrast to conventional single compartment mailboxes which normally include a fixed rear wall, the rear end wall 27 of the container 11 includes a rear door 51 having a bottom edge 52 pivotally connected by a hinge 53 extending therealong to the back end wall 27, the door being swingable in a vertical plane about the hinge member such that the top edge 54 of the door is readily movable between an open position to provide access to the compartment 25, and a closed position to close the compartment, this providing access to mail and the like disposed in the compartment.

It is to be noted that the front door 41 is hinged at the top edge thereof while the rear door 51 is hinged at the bottom end thereof, such that mail inserted through the front door by the carrier will not effect the opening of the back door.

The back door 51 is provided with a convenient and efficient flag or signal device 61 to indicate to the carrier or to the individual that the mail is to be picked up or has been delivered to the mailbox 10. The flag signal 61 comprises an elongated rectangular bar 62 provided at its anchored end 63 with an elongated slot 64 by means of which slot the signal pivots on a mounting pin 65 projecting outwardly from the door 51, the signal pivotable between a downward position as indicated in phantom configuration and designated by reference numeral 61' in FIG. 6, and an upright position where the flag portion 66 of the signal is visible above the top surface 23 of the mailbox 10. To secure the signal in either the upright or downward position, the bar 64 is provided along its terminal end 67 with a transversely extending ridge like projection 68 which projects normal to the axis of the bar outwardly from the surface of the bar in juxtaposition with the exterior surface of the door 51, such ridge like projection frictionally engaging the door surface to maintain the signal in the selected position. Further, adapted to engage the edge of the bar 62 when the signal is in the down position there is provided a pin 68 projecting outwardly from door 51 such as seen in the drawings.

In operation, the mailbox 10 has the bottom surface 21 mounted on a vertical upright, such as a post 71 projecting out of the ground 72, with the front door 41 disposed adjacent the roadway and the back door 51 spaced inwardly of an individual's property away from the roadway, a carrier readily opening the front door 41 to insert mail into the compartment 25 and operating signal 61 to indicate the presence of such mail, an individual then readily removing such mail by opening door 51 and then resetting signal 61 to its downward position, the positioning of the signal on the door reminding the individual of the need to reset the same after withdrawing the mail to prevent false indications of presence of mail to the carrier along the route.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size, and arrangement of parts may be resorted to without departing from the spirit of the invention, the scope of the novel concepts thereof, or the scope of the sub-joined claims.

Having thus described the invention, what is claimed is:

1. A rural type mailbox comprising, in combination:

an elongated hollow housing having a flat elongated rectangular horizontally extending bottom surface, a flat elongated rectangular horizontally extending top surface disposed above and spaced from the bottom surface, and a pair of spaced apart opposed side wall members vertically interconnecting the side edges of the top and bottom members;

a compartment defined interiorly of said surfaces and extending completely therethrough;

a vertical front end wall closing the front of the compartment;

a vertical back end wall closing the back of the compartment;

an opening in the front end wall providing access to the compartment;

a front door member pivotally attached along its top edge to the front end wall of the housing and adapted for swinging pivotal movement thereabout between a normally closed position covering the front wall opening and an open position permitting access to the compartment in the housing;

spring means associated with the front door member urging the same into the normally closed position;

a handle projecting outwardly from the bottom exterior portion of the door adapted to be grasped by an individual's hand to effect the opening of the door;

a magnet secured to the front edge of the bottom housing surface adjacent the bottom edge of the opening in the front end wall and adapted to magnetically engage the back surface of the front door when in the closed position to releasably secure the front door in the closed position;

an opening provided in the back end wall to provide access to the compartment;

a back door member pivotally attached along its bottom edge surface to the bottom portion of the back end wall and swingably operable between a normally closed position covering the back end wall opening and an open position providing access to the compartment;

spring means resiliently retaining the back door member in the normally closed position;

an elongated rectangular corrugated lining member disposed longitudinally along the interior bottom surface of the compartment and including a plurality of side-by-side transversely spaced apart and longitudinally extending ridges and valleys therealong in a manner to support the mail in the compartment resting on the ridges to maintain such mail off the valleys of the corrugated liner which might have moisture, dirt, and other contaminants thereon which would tend to spoil the mail;

signal means pivotally connected to the exterior surface of the back door and movable in a plane parallel to and spaced outwardly from the plane of the door, the signalling means being movable between an upright position projecting above the top surface of the housing and a downward position projecting outwardly of one of the side wall surfaces of the housing;

the signal means comprising:

a flat rectangularly shaped bar member having a flag like signal member connected at one end thereof with the opposite end projecting outwardly from the flag member to be pivotally connected to the exterior surface of the back door;

an elongated slot extending through the terminating end; a pivot pin projecting outwardly of the back door and slidably engaged in the slot of the bar member to permit reciprocal movement of the bar member therealong;

a ridge like projection disposed transversely across the terminating end and projecting outwardly of the surface of the bar member disposed immediately adjacent the exterior surface of the back door, the ridge like projection adapted to frictionally engage the back door for retaining the signal means in a selected position;

the bar being pivotable and slidable about the pivot pin between an upright position and a down position;

a holding pin projecting outwardly of the back door adjacent one edge of the back door and adapted to support the bar when in the down position to retain such selected position;

the side wall members diverge outwardly at their midpoints such that the horizontal area in the compartment defined at the midpoints of the side members is greater than the horizontal area in the compartment defined at either the top surface or the bottom surface of the compartment;

such that mail and the like may be inserted by a mail carrier through the front door which is normally disposed adjacent a roadway, such mail being readily removed by an individual from the back door which is normally disposed away from the roadway.

* * * * *